US009978537B2

(12) United States Patent
Kroeker et al.

(10) Patent No.: US 9,978,537 B2
(45) Date of Patent: May 22, 2018

(54) CONTACT BRIDGE ARRANGEMENT FOR AN ELECTRICAL SWITCHING ELEMENT

(71) Applicant: TE Connectivity Germany GmbH, Bensheim (DE)

(72) Inventors: Matthias Kroeker, Mittenwalde-Ragow (DE); Peter Sandeck, Berlin (DE); Udo Gabel, Berlin (DE); Thomas Haehnel, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days. days.

(21) Appl. No.: 15/203,908

(22) Filed: Jul. 7, 2016

(65) Prior Publication Data

US 2017/0011864 A1 Jan. 12, 2017

(30) Foreign Application Priority Data

Jul. 8, 2015 (DE) ..... 10 2015 212 818

(51) Int. Cl.

| | |
|---|---|
| ***H01H 1/20*** | (2006.01) |
| ***H01H 1/26*** | (2006.01) |
| ***H01H 1/50*** | (2006.01) |
| ***H01H 11/04*** | (2006.01) |
| *H01H 50/54* | (2006.01) |

(52) U.S. Cl.

CPC ..... *H01H 1/20* (2013.01); *H01H 1/26* (2013.01); *H01H 1/50* (2013.01); *H01H 11/04* (2013.01); *H01H 1/2008* (2013.01); *H01H 1/2075* (2013.01); *H01H 50/546* (2013.01); *H01H 2001/265* (2013.01)

(58) Field of Classification Search

CPC ..... H01H 1/20; H01H 1/26; H01H 1/2008; H01H 1/2075; H01H 2001/265; H01H 50/546

USPC ..... 200/243, 16 A, 535

See application file for complete search history.

(56) References Cited

U.S. PATENT DOCUMENTS

| | | | | |
|---|---|---|---|---|
| 3,848,206 | A * | 11/1974 | Prouty | H01H 50/305 200/286 |
| 4,594,484 | A | 6/1986 | Lemmer | |
| 2015/0008105 | A1 | 1/2015 | Haenel et al. | |
| 2017/0011863 | A1* | 1/2017 | Kroeker | H01H 1/26 |

FOREIGN PATENT DOCUMENTS

| | | |
|---|---|---|
| DE | 1102863 | 3/1961 |
| DE | 3834155 A1 | 4/1990 |

OTHER PUBLICATIONS

European search report, dated Nov. 9, 2016, 7 pages.
Abstract of DE3834155, dated Apr. 12, 1990, 2 pages.
German Office Action, dated Apr. 20, 2016, 6 pages.

* cited by examiner

*Primary Examiner* — Vanessa Girardi
(74) *Attorney, Agent, or Firm* — Barley Snyder

(57) ABSTRACT

A contact bridge arrangement for an electrical switch is disclosed that has a contact bridge holder and a contact bridge. The contact bridge holder is monolithically formed with a spring. The contact bridge is held on the contact bridge holder and movable along an actuating direction. The contact bridge is pressed against the contact bridge holder by the spring.

20 Claims, 3 Drawing Sheets

CONTACT BRIDGE ARRANGEMENT FOR AN ELECTRICAL SWITCHING ELEMENT

CROSS-REFERENCE TO RELATED APPLICATIONS

This application claims the benefit of the filing date under 35 U.S.C. § 119(a)-(d) of German Patent Application No. 102015212818.0, filed Jul. 8, 2015.

FIELD OF THE INVENTION

The invention relates to an electrical switch and, more particularly, to a contact bridge arrangement for an electrical switch.

BACKGROUND

Contact bridge arrangements in an electrical switch, such as a relay, are known in the art. For example, DE 102012201966 A1 describes a contact bridge arrangement in which a contact bridge is received in a cage-type contact bridge holder. The contact bridge is movable in an actuating direction with respect to the contact bridge holder and is pressed by a spring against stops of the contact bridge holder. The contact bridge arrangement is designed to exert spring pressure on electrical contact surfaces of the contact bridge in order to guarantee both a good electrical contact to counter-contact elements and to compensate for length tolerances in the actuating direction. Known contact bridge arrangements generally have a more complicated design, are more difficult to assemble, require a larger volume, and consist of more parts than desired.

SUMMARY

The disclosed contact bridge arrangement has a contact bridge holder and a contact bridge. The contact bridge holder has a guiding stop and is monolithically formed with a spring. The contact bridge is held on the contact bridge holder and movable along an actuating direction. The contact bridge is pressed against the guiding stop by the spring.

BRIEF DESCRIPTION OF THE DRAWINGS

The invention will now be described by way of examples with reference to the accompanying figures, of which.

DETAILED DESCRIPTION OF THE EMBODIMENT(S)

The invention is explained in greater detail below with reference to embodiments of a contact bridge arrangement. This invention may, however, be embodied in other different forms, and should not be construed as limited to the embodiments set forth herein; rather, these embodiments are provided so that this disclosure will be thorough and complete and still fully convey the scope of the invention to those skilled in the art.

Figure 1:
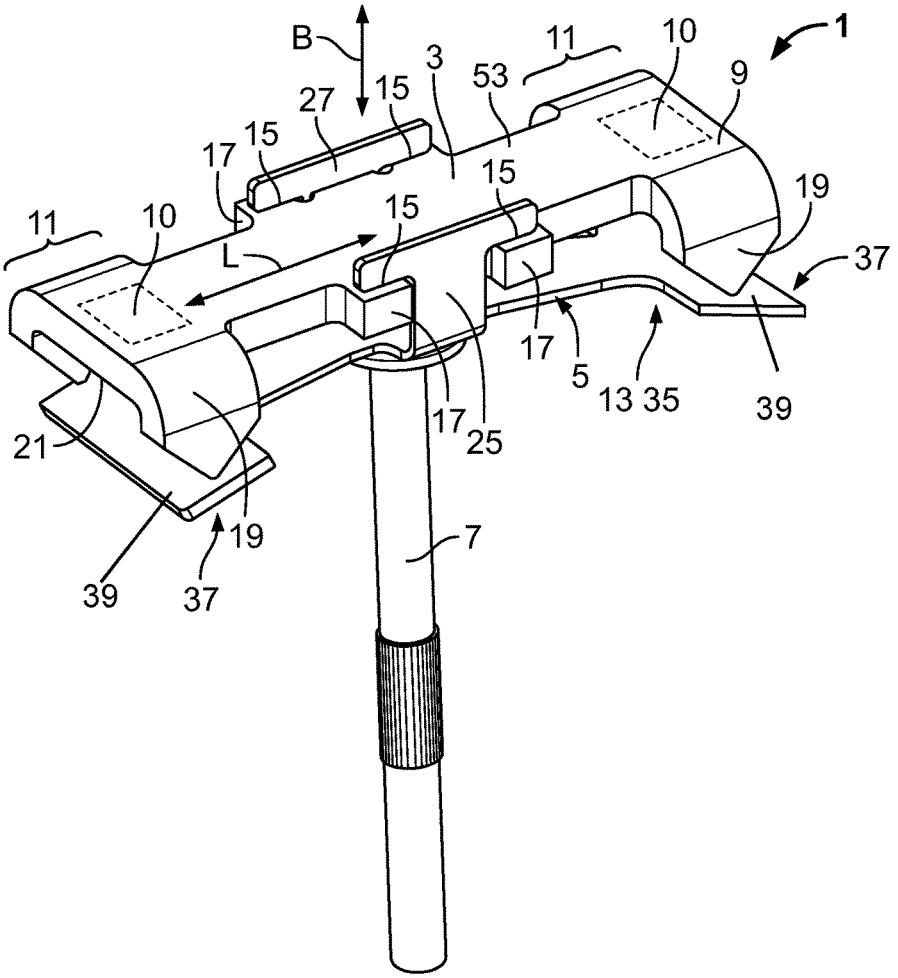
FIG. 1 is a perspective view of a contact bridge arrangement according to the invention.
Figure 2:
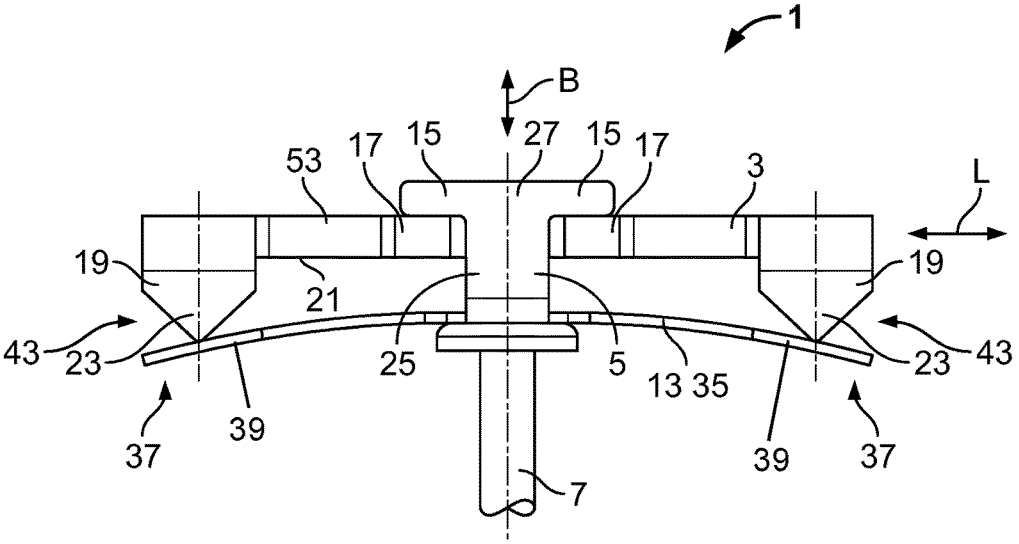
FIG. 2 is a side view of the contact bridge arrangement of FIG. 1.

A contact bridge arrangement 1 according to the invention is shown generally in FIGS. 1 and 2. The contact bridge arrangement 1 has a contact bridge 3 and a contact bridge holder 5.

The major components of the invention will now be described in greater detail.

Contact surfaces 10 of contact bridge 3 are arranged on an upper side 9 of the contact bridge 3. The contact surfaces 10 may be formed by regions of the upper side 9 of the contact bridge 3 or, alternatively, the contact surfaces 10 may be formed by separate components (not shown) which are applied onto the upper side 9. In the shown embodiment, the contact bridge 3 has two contact surfaces 10 which are respectively arranged at end sections 11 of the contact bridge situated opposite one another in longitudinal direction L.

A plurality of bridge stops 17 is positioned centrally on the contact bridge 3 and spaced apart in the longitudinal direction L. The bridge stops 17, as shown in FIG. 1, may be rectangular members projecting from opposite sides of a bridge body 53 in a direction transverse to the longitudinal direction L.

The contact bridge 3 also has spacers 19 positioned at the end sections 11 of the contact bridge. The spacers 19 extend from an underside 21 of the bridge body 53 and may taper at free ends 23 of the bridge body from the underside 21, as shown in FIG. 2. In the shown embodiment, the contact bridge 3 has four spacers 19, with two spacers 19 situated and spaced apart at each end section 11 of the contact bridge, positioned opposite one another in a direction transverse to longitudinal direction L. The spacers 19 may be monolithically formed with the contact bridge 3 by reshaping. If the spacers 19 are formed by reshaping or bending the contact bridge 3, the end sections 11 have a substantially U-shaped cross-section transverse to longitudinal direction L, with the underside 21 of the contact bridge 3 forming the base of the U. The spacers 19 may align with the contact surfaces 10 of contact bridge 3 in longitudinal direction L.

Figure 3:
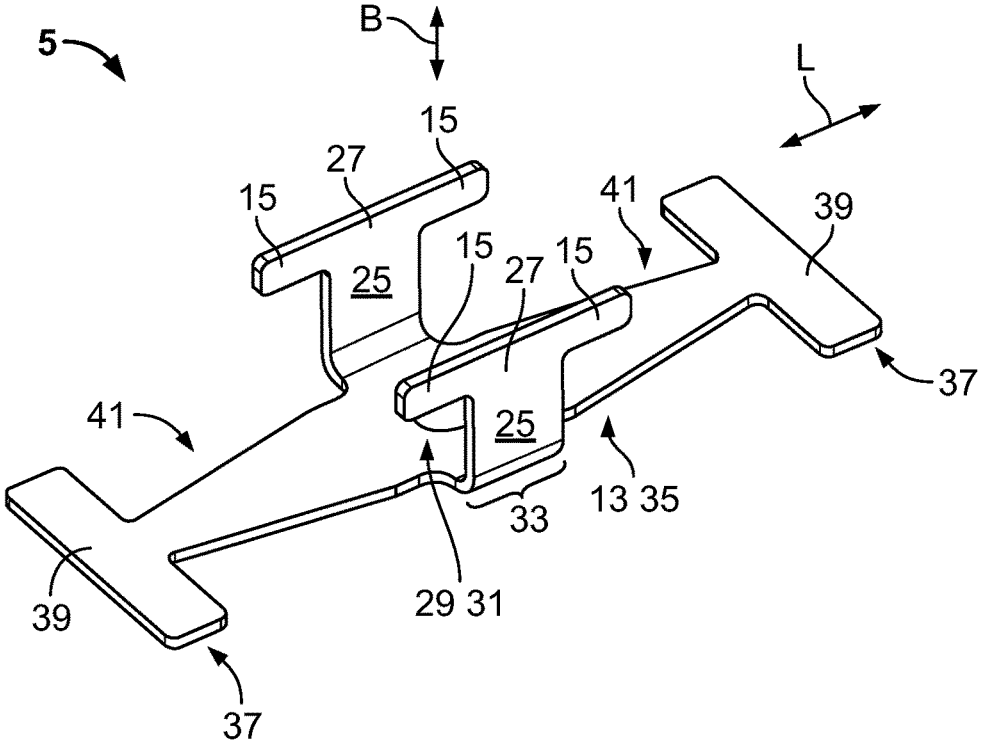
FIG. 3 is a perspective view of the contact bridge holder of the contact bridge arrangement of FIG. 1.
Figure 4:
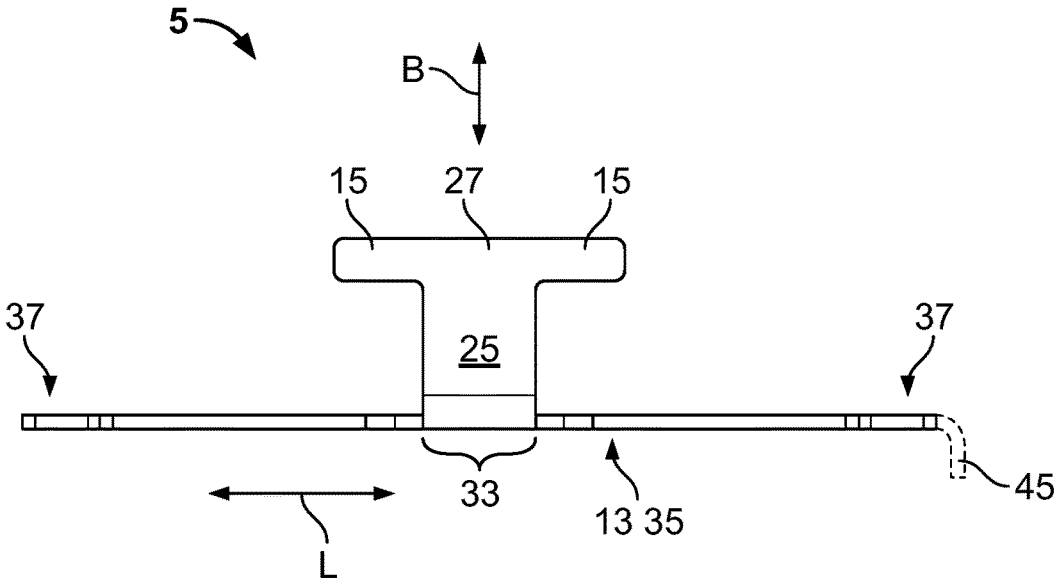
FIG. 4 is a side view of the contact bridge holder of FIG. 3.

The contact bridge holder 5 is shown in FIGS. 3 and 4. The contact bridge holder 5 has a spring 13 and guiding legs 25. The spring 13 and guiding legs 25 may be formed monolithically and the contact bridge holder 5 may be stamped from spring steel.

The spring 13 may be formed as a continuous leaf spring 35 extending in longitudinal direction L. An affixing site 29 is positioned in a middle region 33 of the leaf spring 35. As illustrated, the affixing site 29 may include an aperture 31. Also as illustrated, the opposite free ends 37 of spring 13 or leaf spring 35 have widenings 39, such that the leaf spring 35 is wider in a direction transverse to both the longitudinal direction L and an actuating direction B at free ends 37 of the leaf spring. The widenings 39 may form a T-shape at the free ends 37 of leaf spring 35. The leaf spring 35, in the shown embodiment, has tapered sections 41 between the middle region 33 of the leaf spring and the free ends 37 of the leaf spring. Due to tapered sections 41, the leaf spring 35 can be configured to be more elastic than a leaf spring with a uniform cross-section. The leaf spring 35, as shown in FIG. 4, may be reshaped at a free end 37 to form a stiffening structure 45 extending in the actuating direction B.

The spring 13 is not restricted to one leaf spring 35. A conical spring may also be part of the spring 13 and a portion of the contact bridge holder 5 may be stamped out around the affixing site 29 of the contact bridge holder and drawn to monolithically form the conical spring. The spring 13 may further include, in addition or alternatively, more leaf springs 35 to form a stack of leaf springs 35 or a monolithically formed leaf spring 35 and an additional spiral or conical spring.

The guiding legs 25 of contact bridge holder 5 extend in the actuating direction B from the middle region 33 of the contact bridge holder. The guiding legs 25 are parallel and spaced apart from one another such that, in the region of the guiding legs 25, the contact bridge holder 5 has a U-shaped cross-section in a direction transverse to longitudinal direction L. The affixing site 29, as illustrated, is between the guiding legs 25. At their free ends 27, the guiding legs 25 have guiding stops 15. The guiding stops 15 each extend parallel to longitudinal direction L, forming a T-shaped guiding legs 15.

The assembly and use of the contact bridge arrangement 1 will now be described with reference to FIGS. 1 and 2. The contact bridge 3 is held on the contact bridge holder 5 in a moveable manner along the actuating direction B.

The contact bridge holder 5 is positioned, with respect to the contact bridge 3, such that the spring 13 of the contact bridge holder is disposed under the underside 21 of the contact bridge body 53 of the contact bridge, extending substantially parallel to a longitudinal axis of the contact bridge 3 and perpendicular to the actuating direction B. The guiding legs 25 of contact bridge holder 5 may be elastically curved away from one another in order to insert the contact bridge 3. Each guiding leg 25 of contact bridge holder 5 extends in a space between a pair of bridge stops 17 of the contact bridge 3 and bears against the contact bridge 3 in the space, such that the contact bridge 3 is held in a form-fitting manner in longitudinal direction L. The guiding legs 25 of the contact bridge holder 5, positioned between the bridge stops 17 of the contact bridge, guide motion of the contact bridge 3 in actuating direction B.

The guiding stops 15 of guiding legs 25 of contact bridge holder 5 extend above a top surface of the bridge stops 17 of contact bridge 3. The number of bridge stops 17 corresponds to the number of guiding stops 15. The spring 13 imparts a spring force pressing the bridge stops 17 of contact bridge 3 against the guiding stops 15 of contact bridge holder 5 in actuating direction B. Some bridge stops 17 may bear against guiding stops 15 even when the contact bridge 3 is in a tilted position with respect to the contact bridge holder 5, in order to enable the contact surfaces 10 to rest effectively against counter-contact elements.

The ends 37 of the leaf spring 35 bear against the spacers 19 or underside 21 of the contact bridge 3. The widenings 39 of leaf spring 35 are at least as wide as the spacers 19 and, in the shown embodiment, each widening 39 bears on two spacers 19. As shown in FIGS. 1 and 2, the spacers 19 press onto the widenings 39, curving the leaf spring 35 away from the contact bridge 3 at the ends 37 and toward the contact bridge 3 in the middle region 33. As a result, the leaf spring 35 is tensed and the spring force of the leaf spring 35 presses the contact bridge 3 in actuating direction B against the guiding stops 15 of contact bridge holder 5.

Due to the positioning of the spacers 19 of contact bridge 3, the spring force of the leaf spring 35 of contact bridge holder 5 is transmitted onto the entire width of the contact bridge 3 transverse to longitudinal direction L. Since the contact bridge holder 5 is curved by the pressure of the spacers 19 on the ends 37 of the contact bridge holder, the spacers 19 serve as a centering arrangement 43 acting to center the leaf spring 35. In embodiments in which the contact surfaces 10 of contact bridge 3 are aligned with the spacers 19 of the contact bridge in the longitudinal direction L, the spring force of the spring 13 is directly transmitted onto the contact surfaces 10 via the spacers 19.

The leaf spring 35 may alternatively, prior to assembly of the contact bridge arrangement, be curved in an opposite direction to that shown in FIGS. 1 and 2. If a contact bridge 3 is then inserted into the contact bridge holder 5, the leaf spring 35 can press, by its ends 37, against the underside 21 of the contact bridge 3. As a result, it is possible to dispense with spacers 19 in this alternative. A combination of a contact bridge 3 with spacers 19 and an oppositely curved leaf spring 35 is also possible.

In a further alternative, curving of the leaf spring 35 between the spacers 19 can be prevented by the stiffening structure 45. Two stiffening structures 45, each of which is arranged on an end 37 of the leaf spring 35 as shown in FIG. 4, may be provided to stiffen the leaf spring 35.

An actuator system may be provided to move the contact bridge holder 5 with respect to the contact bridge 3. In FIGS. 1 and 2, the contact bridge arrangement 1 is depicted with a shaft 7 of the actuator system. The shaft 7 extends through the aperture 31 of contact bridge holder 5 in actuating direction B and can be connected to the contact bridge holder 5 at the affixing site 29 of the contact bridge holder. This can, for example, be achieved by pressing, riveting, welding or by any other suitable affixing method. Motion of the shaft 7 in the actuating direction B imparts motion to the contact bridge holder 5 such that the leaf spring 35 bends further and the guiding legs 25 of the contact bridge holder move between the bridge stops 17 of contact bridge 3 in actuating direction B.

Figure 5:
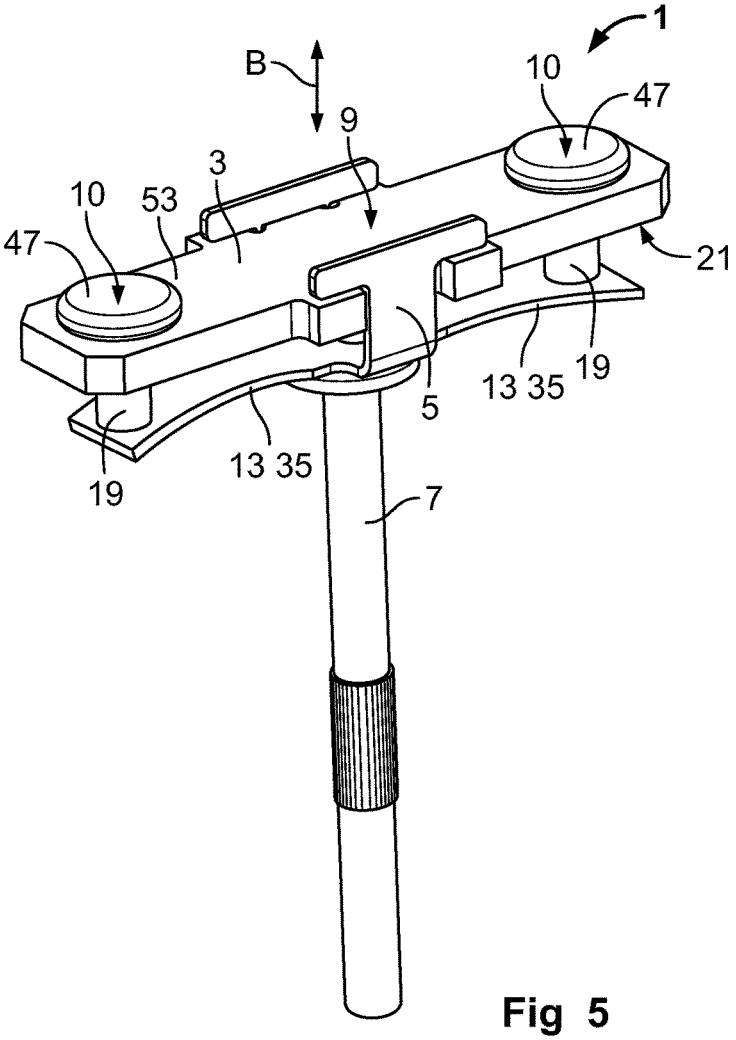
FIG. 5 is a perspective view a contact bridge arrangement according to another embodiment of the invention.
Figure 6:
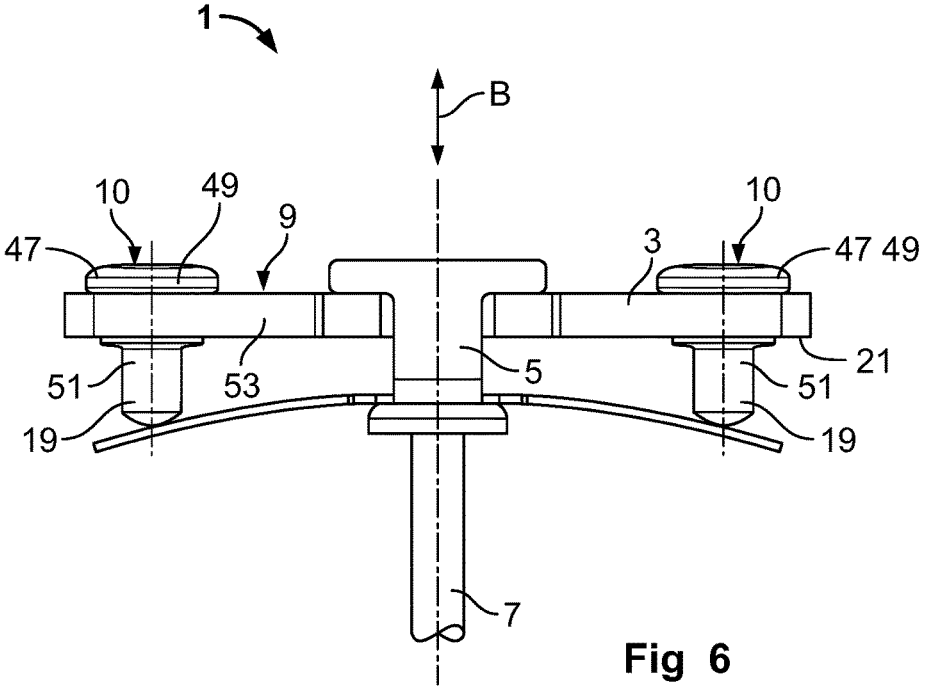
FIG. 6 is a side view of the contact bridge arrangement of FIG. 5.

Another embodiment of a contact bridge arrangement 1 according to the invention is shown in FIGS. 5 and 6. For the sake of brevity, only differences from the embodiment of FIGS. 1-4 will be described.

The spacers 19 of contact bridge 3 of the embodiment of FIGS. 5 and 6 are not formed by reshaping. Instead, the contact bridge 3 has contact elements 47 which completely penetrate the contact bridge 3 in actuating direction B. The contact elements 47 form, on the upper side 9 of the contact bridge 3, the contact surfaces 10 and, on the underside 21 of the contact bridge 3, the spacers 19.

The contact elements 47 may be formed as rivets which are inserted in apertures in the contact bridge 3. The contact elements 47 have a rivet head 49 and a bolt 51 extending from the rivet head 49. The rivet head 49 may have a larger diameter transverse to actuating direction B than the bolt 51. When positioned in the contact bridge 3, the rivet head 49 can form the contact surface 10 and, by its bolt 51, the spacer 19. In the shown embodiment, two contact elements 47 are disposed opposite one another on contact bridge 3 in longitudinal direction L.

In the embodiment shown in FIGS. 5 and 6, the leaf spring 35 may be formed without widenings 39 and without tapers 41 to simplify the design and production. If the widenings 39 alternatively remained on the leaf spring 35, the widenings 39 would then project beyond the spacers 19 transverse to longitudinal direction L and transverse to actuating direction B.

Advantageously, the contact bridge arrangement 1 according to the invention offers substantial advantages over known devices. The monolithic form of the at least one spring 13 with the contact bridge holder 5 first makes it possible to reduce the number of parts in the contact bridge arrangement 1. Additionally, it is possible to dispense with elements used to hold the spring 13 when assembling the contact bridge arrangement 1. Through the smaller number of parts, a smaller overall size can be achieved. Since the at least one spring 13 can additionally be manufactured together with the contact bridge holder 5, the properties of the spring 13 can be selected and adjusted optimally to the contact bridge holder 5. Further, by using a leaf spring 35 instead of a spiral spring, a smaller overall size can be achieved at least in actuating direction B. Additionally, through the tapered sections 41, material can be saved, the structural volume can be reduced, and higher elasticity can be achieved in the region of the free ends 37 of leaf spring 35. The centering arrangement 43, formed by the spacers 19, is also advantageous if the contact bridge 3 is held with play between the guiding legs 25 of the contact bridge holder 5, while the position of the spacers 19 also allows the spring force to be directly transmitted onto the contact surfaces 10 of contact bridge 3, which avoids excessively stressing the contact bridge 3 in contrast to known arrangements.

In another advantageous embodiment of the contact bridge arrangement 1, by using the contact elements 47 as spacers 19, the contact bridge 3 can be formed particularly simply. The contact bridge body 53 can be formed from one block or be stamped from a material without being reshaped further. In this case, it is possible to dispense with method steps such as bending round, chamfering or cranking.

What is claimed is:

1. A method of manufacturing a contact bridge arrangement for an electrical switch, comprising:

producing a monolithic contact bridge holder having a guiding stop and a spring by stamping; and positioning a contact bridge on the contact bridge holder movable along an actuating direction and pressed against the guiding stop by the spring, the contact bridge having a pair of spacers extending from an underside of the contact bridge, the spacers separated from one another in a direction transverse to a longitudinal direction of the contact bridge and bearing against the spring.

2. A contact bridge arrangement for an electrical switch, comprising:

a contact bridge holder having a guiding stop and monolithically formed with a spring; and a contact bridge held on the contact bridge holder, movable along an actuating direction, and pressed against the guiding stop by the spring, the contact bridge having a pair of spacers extending from an underside of the contact bridge, the spacers separated from one another in a direction transverse to a longitudinal direction of the contact bridge and bearing against the spring.

3. The contact bridge arrangement of claim 2, further comprising an actuator system attached to the affixing site.

4. The contact bridge arrangement of claim 2, wherein the spring has an affixing site in a middle region and two opposite ends.

5. The contact bridge arrangement of claim 4, wherein the spring has a stiffening structure extending perpendicular to the longitudinal direction.

6. A contact bridge arrangement for an electrical switch, comprising:

a contact bridge holder:

(a) movable in an actuating direction and in a deactuating direction opposite the actuating direction, and (b) having:

(1) a pair of guiding legs, each guiding leg having a guiding stop, and (2) a spring monolithically formed as part of the contact bridge holder; and a contact bridge:

(a) held in the contact bridge holder between the pair of guiding legs, and (b) having a bridge stop pressed by the spring against each guiding stop of each guiding leg of the contact bridge holder and a pair of spacers extending from an underside of the contact bridge, the spacers separated from one another in a direction transverse to a longitudinal direction of the contact bridge and bearing against the spring.

7. The contact bridge arrangement of claim 1, wherein the spacers are monolithically a part of the contact bridge.

8. The contact bridge arrangement of claim 1, wherein both spacers are positioned at one end of the contact bridge and form a U-shaped cross-section transverse to the longitudinal direction.

9. The contact bridge arrangement of claim 1, wherein the spring is a leaf spring.

10. The contact bridge arrangement of claim 9, wherein the spacers space the leaf spring from the underside of the contact bridge.

11. The contact bridge arrangement of claim 9, wherein the leaf spring extends substantially transverse to the actuating and deactuating directions.

12. The contact bridge arrangement of claim 11, wherein the leaf spring extends substantially parallel to a longitudinal direction of the contact bridge.

13. The contact bridge arrangement of claim 12, wherein the leaf spring is curved toward the underside of the contact bridge.

14. The contact bridge arrangement of claim 9, wherein the leaf spring has a tapered section between the middle of the leaf spring and at least one end.

15. The contact bridge arrangement of claim 14, wherein the leaf spring has a widened section at least at one end.

16. The contact bridge arrangement of claim 15, wherein the widened section extends transverse to a longitudinal direction of the contact bridge.

17. A contact bridge arrangement for an electrical switch, comprising:

a contact bridge holder:

(a) movable in an actuating direction and in a deactuating direction opposite the actuating direction, and (b) having:

(1) a pair of guiding legs, each guiding leg having a guiding stop, and (2) a spring monolithically formed as part of the contact bridge holder;

a contact bridge:

(a) held in the contact bridge holder between the pair of guiding legs, and (b) having a bridge stop pressed by the spring against each guiding stop of each guiding leg of the contact bridge holder and a spacer extending from an underside of the contact bridge and bearing against the spring; and a contact element extending through the contact bridge and forming the spacer.

18. A contact bridge arrangement for an electrical switch, comprising:

a contact bridge holder:

(a) movable in an actuating direction and in a deactuating direction opposite the actuating direction, and (b) having:

(1) a pair of guiding legs, each guiding leg having a guiding stop, and (2) a leaf spring monolithically formed as part of the contact bridge holder, the leaf spring having a tapered section between a middle of the leaf spring and at least one end; and a contact bridge:

(a) held in the contact bridge holder between the pair of guiding legs, and (b) having a bridge stop pressed by the spring against each guiding stop of each guiding leg of the contact bridge holder and a spacer extending from an underside of the contact bridge and bearing against the spring.

19. The contact bridge arrangement of claim 18, wherein the leaf spring has a widened section at least at one end.

20. The contact bridge arrangement of claim 19, wherein the widened section extends transverse to a longitudinal direction of the contact bridge.

* * * * *